US010738638B2

(12) United States Patent
Chouhan et al.

(10) Patent No.: US 10,738,638 B2
(45) Date of Patent: Aug. 11, 2020

(54) ROTOR BLADE WITH WHEEL SPACE SWIRLERS AND METHOD FOR FORMING A ROTOR BLADE WITH WHEEL SPACE SWIRLERS

(71) Applicant: General Electric Company, Schenectady, NY (US)

(72) Inventors: Rohit Chouhan, Bangalore (IN); Soumyik Bhaumik, Bangalore (IN)

(73) Assignee: General Electric Company, Schenectady, NY (US)

( * ) Notice: Subject to any disclaimer, the term of this patent is extended or adjusted under 35 U.S.C. 154(b) by 933 days.

(21) Appl. No.: 15/257,986

(22) Filed: Sep. 7, 2016

(65) Prior Publication Data

US 2017/0002673 A1 Jan. 5, 2017

Related U.S. Application Data

(63) Continuation-in-part of application No. 14/603,314, filed on Jan. 22, 2015.

(51) Int. Cl.
*F01D 11/00* (2006.01)

(52) U.S. Cl.
CPC ..... *F01D 11/001* (2013.01); *F05D 2230/12* (2013.01); *F05D 2230/13* (2013.01); *F05D 2230/21* (2013.01); *F05D 2240/126* (2013.01)

(58) Field of Classification Search
CPC ..... F01D 11/00; F01D 11/001; F01D 11/02; F01D 11/12; F01D 11/122; F01D 11/127; F01D 5/147
See application file for complete search history.

(56) References Cited

U.S. PATENT DOCUMENTS 7,044,710 B2 5/2006 Naik et al.
7,114,339 B2 10/2006 Alvanos et al.
(Continued)

FOREIGN PATENT DOCUMENTS

DE 10 2006 043 744 A1 3/2007
EP 1 895 108 A2 3/2008
(Continued)

OTHER PUBLICATIONS

Extended European Search Report and Opinion issued in connection with related EP Application No. 16152213.1 dated Dec. 21, 2016.
(Continued)

*Primary Examiner* — Justin D Seabe
*Assistant Examiner* — Cameron A Corday
(74) *Attorney, Agent, or Firm* — Dority & Manning, P.A.

(57) ABSTRACT

The present disclosure is directed to a rotor blade and method for forming the rotor blade. The rotor blade includes a platform having a bottom side radially spaced from a top side and a leading edge portion axially spaced from a trailing edge portion. An airfoil extends radially outwardly from the top side of the platform and a shank extends radially inwardly from the bottom side of the platform. The shank includes a lip that extends axially outwardly from a forward wall of the shank. The lip defines a radially inward surface and a radially outward surface and a plurality of slots. Swirler vane inserts are disposed within respective slots of the plurality of slots. Each swirler vane insert extends radially inwardly from the inward surface of the lip and axially outwardly from the forward wall of the shank.

19 Claims, 6 Drawing Sheets

(56) References Cited

U.S. PATENT DOCUMENTS

| | | | | |
|---|---|---|---|---|
| 7,189,055 | B2 | 3/2007 | Marini et al. | |
| 7,189,056 | B2 | 3/2007 | Girgis et al. | |
| 7,244,104 | B2 | 7/2007 | Girgis et al. | |
| 7,665,964 | B2 | 2/2010 | Taylor et al. | |
| 8,419,356 | B2 | 4/2013 | Little | |
| 2010/0074733 | A1 | 3/2010 | Little | |
| 2013/0108441 | A1 | 5/2013 | Ingram | |
| 2014/0003919 | A1* | 1/2014 | Lee | F01D 11/001 415/173.7 |
| 2014/0147250 | A1 | 5/2014 | Lee et al. | |
| 2016/0215624 | A1 | 7/2016 | Chouhan et al. | |
| 2016/0215625 | A1 | 7/2016 | Chouhan et al. | |
| 2016/0215626 | A1 | 7/2016 | Chouhan et al. | |
| 2016/0215636 | A1 | 7/2016 | Chouhan et al. | |

FOREIGN PATENT DOCUMENTS

| | | | |
|---|---|---|---|
| EP | 2 116 692 | A2 | 11/2009 |
| WO | WO2011029420 | A1 | 3/2011 |

OTHER PUBLICATIONS

Chouhan, et al., filed Jan. 22, 2015, U.S. Appl. No. 14/603,321.
Chouhan, et al., filed Jan. 22, 2015, U.S. Appl. No. 14/603,318.
Chouhan, et al., filed Jan. 22, 2015, U.S. Appl. No. 14/603,316.
Chouhan, et al., filed Jan. 22, 2015, U.S. Appl. No. 14/603,314.
Chouhan, et al., filed Jul. 22, 2016, U.S. Appl. No. 15/217,212.
Chouhan, et al., filed Jul. 22, 2016, U.S. Appl. No. 15/216,881.

* cited by examiner

ROTOR BLADE WITH WHEEL SPACE SWIRLERS AND METHOD FOR FORMING A ROTOR BLADE WITH WHEEL SPACE SWIRLERS

CROSS REFERENCE TO RELATED APPLICATION

The present application claims priority to U.S. application Ser. No. 14/603,314, filed on Jan. 22, 2015, which is incorporated herein by reference in its entirety and for all purposes. Any disclaimer that may have occurred during prosecution of the above-referenced application is hereby expressly rescinded.

FIELD OF THE TECHNOLOGY

The present disclosure generally relates to a turbine blade for a gas turbine engine. More particularly, the present disclosure relates to a rotor blade with wheel space swirlers and related method for forming the rotor blade with wheel space swirlers.

BACKGROUND

As is known in the art, gas turbines employ rows of buckets or rotor blades on the wheels/rotor disks of a rotor assembly, which alternate with rows of stationary vanes on a stator or nozzle assembly. These alternating rows extend axially along the rotor and stator and allow combustion gasses to turn the rotor as the combustion gasses flow therethrough.

Axial/radial openings at the interface between rotating rotor blades and stationary nozzles can allow hot combustion gasses to exit the hot gas path and radially enter the intervening wheel space between bucket rows. To limit such incursion of hot gasses, the bucket structures typically employ axially-projecting angel wings, which cooperate with discourager members extending axially from an adjacent stator or nozzle. These angel wings and discourager members overlap but do not touch, and serve to restrict incursion of hot gasses into the wheel space.

In addition, cooling air or "purge air" is often introduced into the wheel space between bucket rows. This purge air serves to cool components and spaces within the wheel spaces and other regions radially inward from the rotor blades as well as providing a counter flow of cooling air to further restrict incursion of hot gasses into the wheel space. Angel wing seals therefore are further designed to restrict escape of purge air into the hot gas flow path.

Nevertheless, most gas turbines exhibit a significant amount of purge air escape into the hot gas flow path. For example, this purge air escape may be between 0.1% and 3.0% at the first and second stage wheel spaces. The consequent mixing of cooler purge air with the hot gas flow path results in large mixing losses, due not only to the differences in temperature but also to the differences in flow direction or swirl of the purge air and hot gasses.

In addition, the mixing of purge air and the hot gas flow results in a more chaotic flow of gasses across the platform of the turbine bucket. This increase in chaotic gas flow results in unequal heating of the platform during operation of the turbine, with attendant increases in thermal stresses to the platform and a resultant shortening of the working life of the turbine bucket.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to a rotor blade. The rotor blade includes a platform having a bottom side radially spaced from a top side and a leading edge portion axially spaced from a trailing edge portion. An airfoil extends radially outwardly from the top side of the platform and a shank extends radially inwardly from the bottom side of the platform. The shank includes a forward wall, an aft wall, a pressure side wall and a suction side wall and a lip that extends axially outwardly from the forward wall. The lip defines a radially inward surface and a radially outward surface and a plurality of slots. The rotor blade further includes a plurality of swirler vane inserts. Each swirler vane insert is disposed within a respective slot of the plurality of slots. Each swirler vane insert extends radially inwardly from the inward surface of the lip and axially outwardly from the forward wall of the shank.

A further aspect of the present disclosure is directed to a method for manufacturing and/or modifying a rotor blade. The method includes forming a slot in a lip of the rotor blade where the lip extends axially outwardly from a forward wall of a shank of the rotor blade and where the lip defines a radially inward surface and a radially outward surface. The method also includes inserting a swirler vane insert into the slot where the swirler vane insert extends radially inwardly from the inward surface of the lip and axially outwardly from the forward wall of the shank and fixedly connecting the swirler vane insert to the lip.

Another aspect of the present disclosure is directed to a method for manufacturing and/or modifying a rotor blade. The method includes forming a plurality of swirler vanes across a lip of the rotor blade where the lip extends axially outwardly from a forward wall of a shank of the rotor blade and where each swirler vane extends radially inwardly from a radially inward surface of the lip and extends axially outwardly from a forward wall of the shank of the rotor blade.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
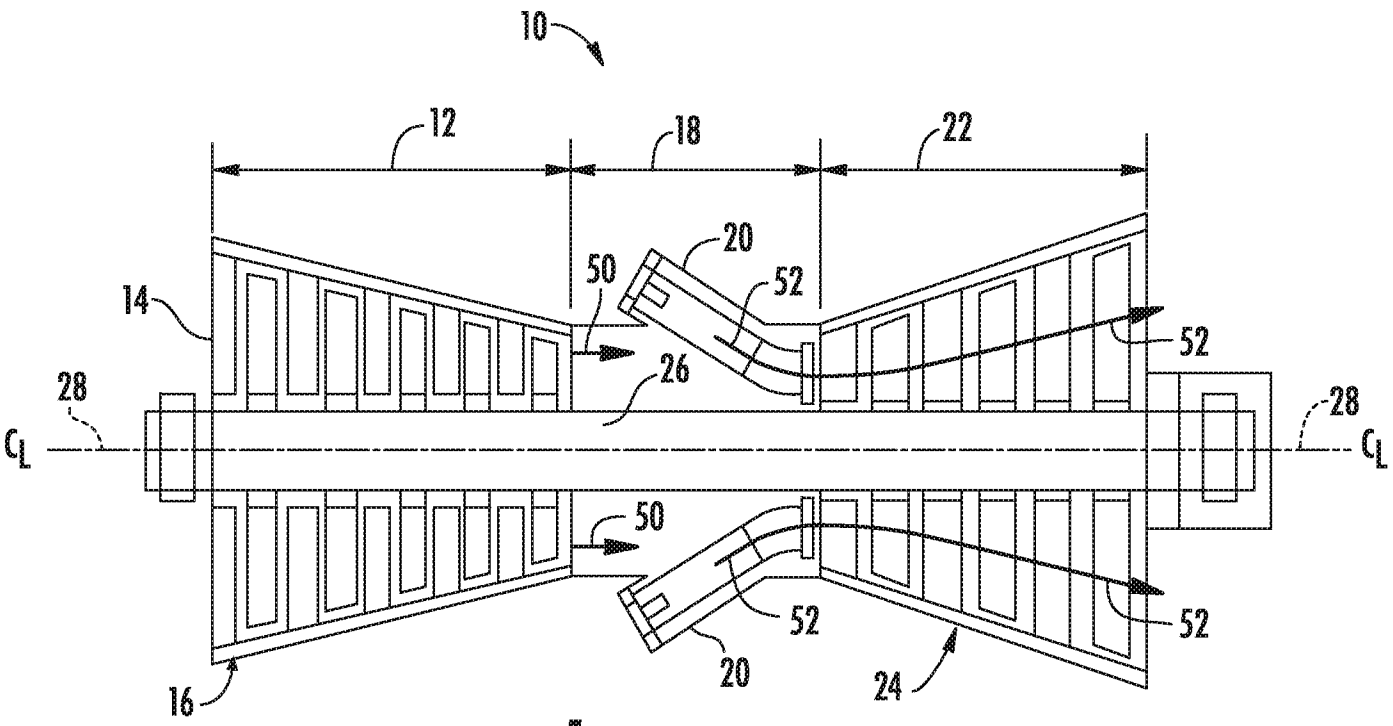
FIG. 1 is a schematic view of an exemplary gas turbine engine that may incorporate various embodiments disclosed herein.

Repeat use of reference characters in the present specification and drawings is intended to represent the same or analogous features or elements of the present technology.

DETAILED DESCRIPTION OF THE TECHNOLOGY

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

Although exemplary embodiments of the present disclosure will be described generally in the context of a land-based power-generating gas turbine for purposes of illustration, one of ordinary skill in the art will readily appreciate that embodiments of the present disclosure may be applied to any type of turbomachine and are not limited to land-based power-generating gas turbines unless specifically recited in the claims.

Referring now to the drawings, FIG. 1 is a schematic view of an exemplary gas turbine engine 10 that may incorporate various embodiments disclosed herein. As shown, the gas turbine engine 10 generally includes a compressor section 12 having an inlet 14 disposed at an upstream end of a compressor 16 (e.g., an axial compressor). The gas turbine engine 10 also includes a combustion section 18 having one or more combustors 20 positioned downstream from the compressor 16. The gas turbine engine 10 further includes a turbine section 22 having a turbine 24 (e.g., an expansion turbine) disposed downstream from the combustion section 18. A rotor shaft 26 extends axially through the compressor 16 and the turbine 24 along an axial centerline 28 of the gas turbine engine 10.

Figure 2:
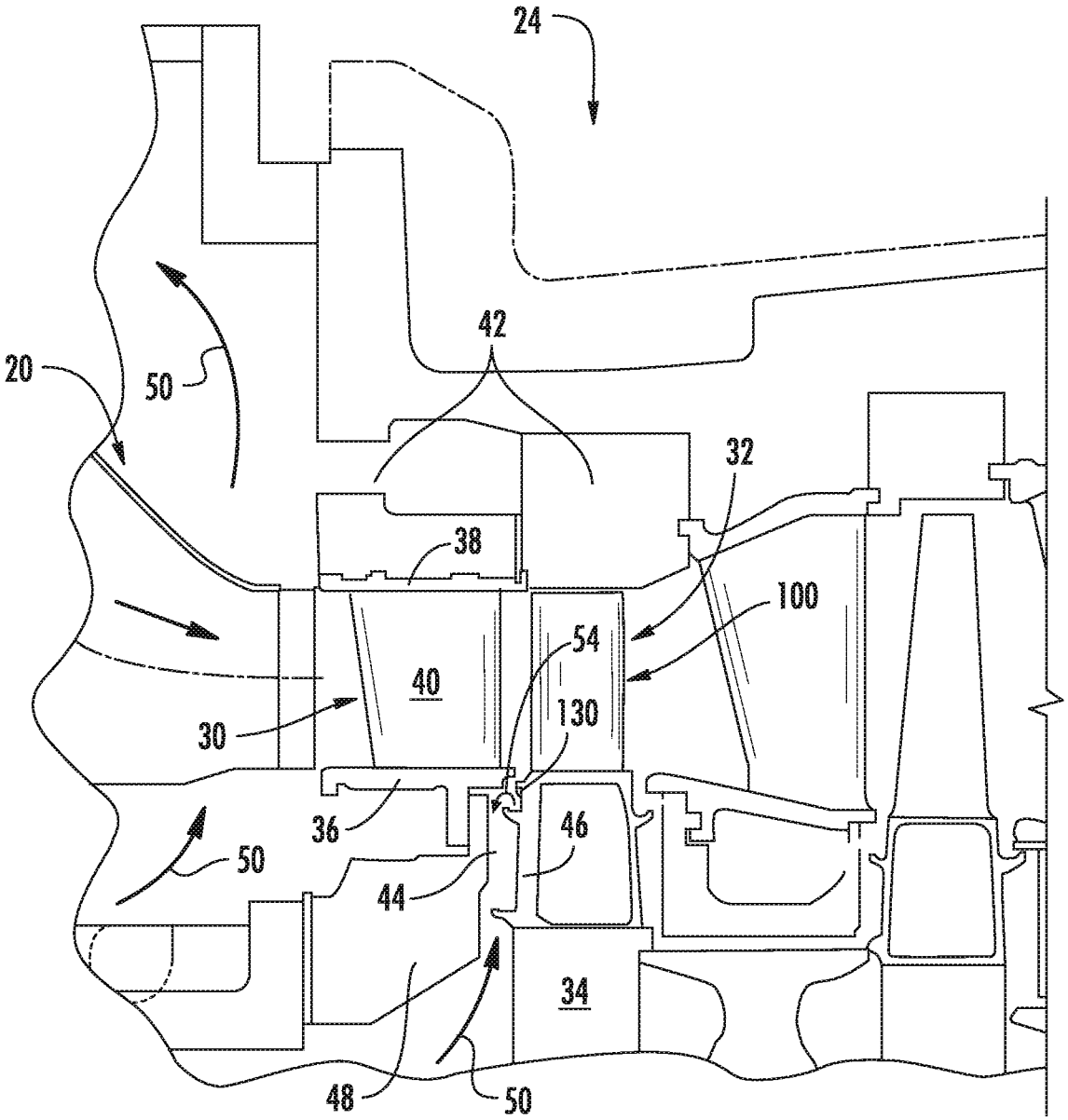
FIG. 2 is a cross-sectional view of an exemplary turbine section that may be incorporated in the gas turbine engine shown in FIG. 1 and may incorporate various embodiments disclosed herein.

FIG. 2 is a cross-sectional side view of the turbine 24 that may incorporate various embodiments disclosed herein. As shown in FIG. 2, the turbine 24 may include multiple rows of turbine nozzles 30 and rotor blades 32 axially spaced along the rotor shaft 26 (FIG. 1). The turbine nozzles 30 are mounted to the turbine 24 or to other structural mounting hardware of the turbine 24 and remain stationary during turbine operation. Each row of the rotor blades 32 may be coupled to the rotor shaft 26 (FIG. 1) via a respective rotor wheel or disk 34. In various embodiments, the turbine nozzles 30 include an inner radial band 36, an outer radial band 38 and a vane 40 that extends radially therebetween. The inner radial band 36 and the outer radial band 38 define radially inner and outer hot gas path flow boundaries within the turbine 24.

The multiple rows of turbine nozzles 30 and rotor blades 32 may be subdivided into multiple stages whereby each stage includes a row of the turbine nozzles 30 and a row of the rotor blades 32 disposed immediately downstream from the respective row of the turbine nozzles 30. The turbine 24 may include more or less turbine stages than illustrated in FIG. 2. For example, the turbine 24 may include 1, 2, 3, 4 or more stages.

A first stage 42 of the turbine nozzles 30 and the rotor blades 32 is disposed immediately downstream from the combustors 20 and as such is exposed to the highest temperature combustion gases. As shown in FIG. 2, a first wheel space or pocket 44 is formed between a shank portion 46 of each rotor blade 32 and/or a portion of the rotor wheel 34 of the first stage 36 and structural hardware 48 such as an inner portion of a corresponding turbine nozzle and/or a nozzle mounting ring of the gas turbine 10.

During operation, as illustrated in FIGS. 1 and 2 collectively, the compressor 16 provides compressed air 50 to the combustors 20. The compressed air 50 mixes with fuel (e.g., natural gas) in the combustors 20 and burns to create combustion gases 52, which flow into the turbine 24. The various stages of turbine nozzles 30 and rotor blades 32 extract kinetic and/or thermal energy from the combustion gases 46 as the combustion gases flow through the turbine 24. This energy extraction drives the rotor shaft 26. The combustion gases 52 then exit the turbine 24. In order to provide cooling to the turbine nozzles 30, the rotor blades 32 and/or to prevent the combustion gases from leaking into the wheel space 44, a portion of the compressed air 50 from the compressor 16 may be routed into the wheel space 44. However, stagnation or recirculation zones 54 may develop at a flow boundary or interface defined between the compressed air 50 within the wheel space 44 and the combustion gases 52 flowing through the turbine 24.

Figure 3:
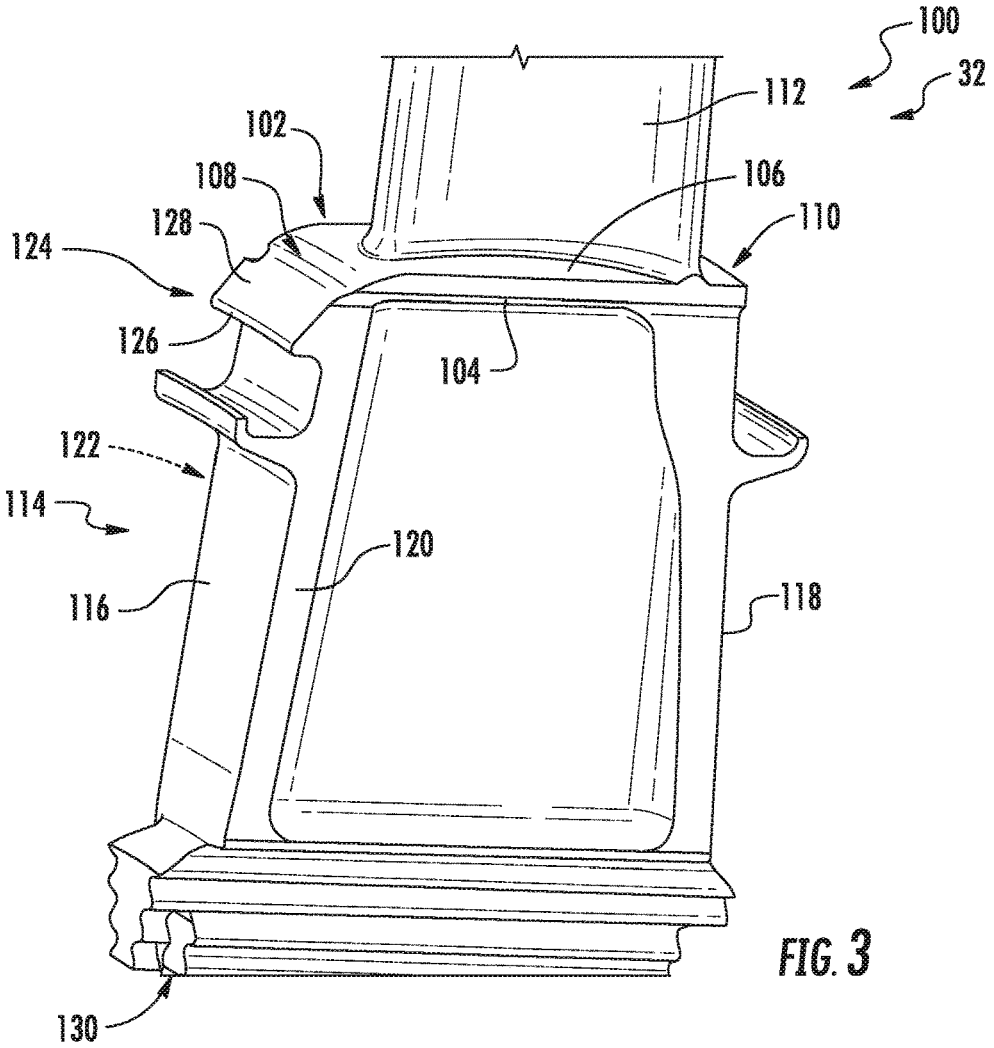
FIG. 3 provides a perspective view of an exemplary rotor blade as may incorporate one or more embodiments of the present invention.

FIG. 3 provides a perspective view of an exemplary rotor blade 100 which may incorporate various embodiments of the present invention and which may be incorporated into the turbine 24 in place of rotor blade 32 shown in FIG. 2. In particular embodiments, as shown in FIG. 3, the rotor blade 100 includes a platform 102 having a bottom side 104 that is radially spaced from a top side 106. The platform 102 further includes a leading edge portion 108 which is axially spaced from a trailing edge portion 110. The rotor blade 100 further includes an airfoil 112 that extends radially outwardly from the top side 106 of the platform 102.

The rotor blade 100 includes a shank 114 that extends radially inwardly from the bottom side 104 of the platform 102. The shank 114 includes a forward wall 116, an aft wall 118, a pressure side wall 120, a suction side wall 122 and a lip or protrusion 124 that extends radially along and axially outwardly from the forward wall 116. The lip 124 defines a radially inward surface 126 and a radially outward surface 128. In particular embodiments, the radially outward surface 128 of the lip 124 may be blended or continuous with the leading edge portion 108 of the platform 102. In particular embodiments, the rotor blade 100 may further include a root portion 130 formed to mount within a complementary slot (not shown) formed in the rotor wheel 34 (FIG. 2).

Figure 4:
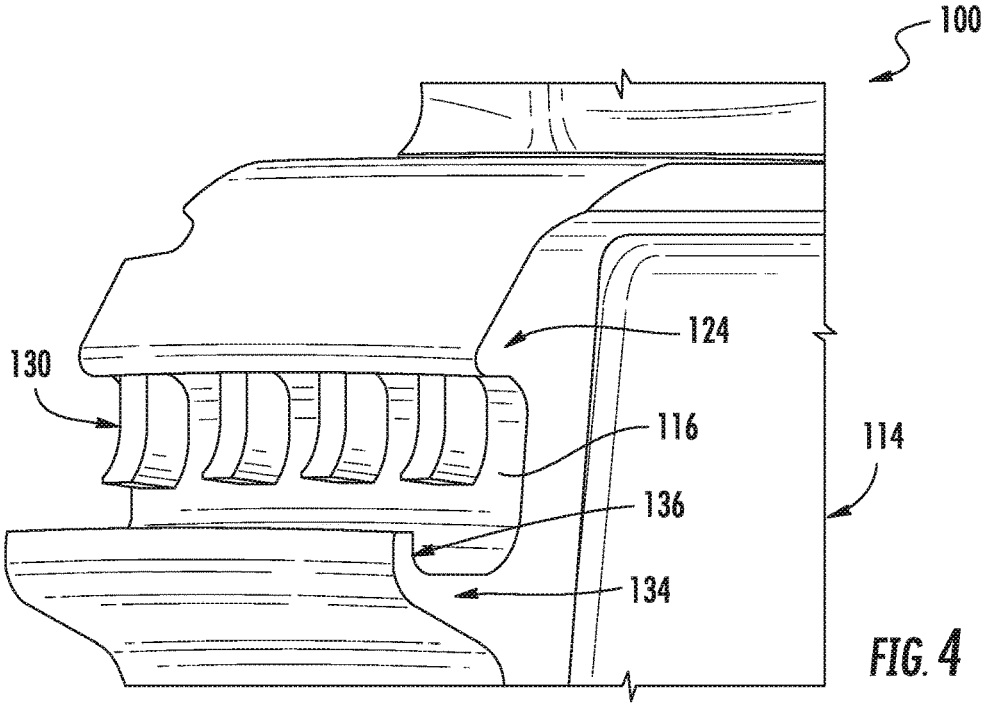
FIG. 4 provides an enlarged perspective view of a portion of an exemplary rotor blade, according to at least one embodiment of the present disclosure.
Figure 5:
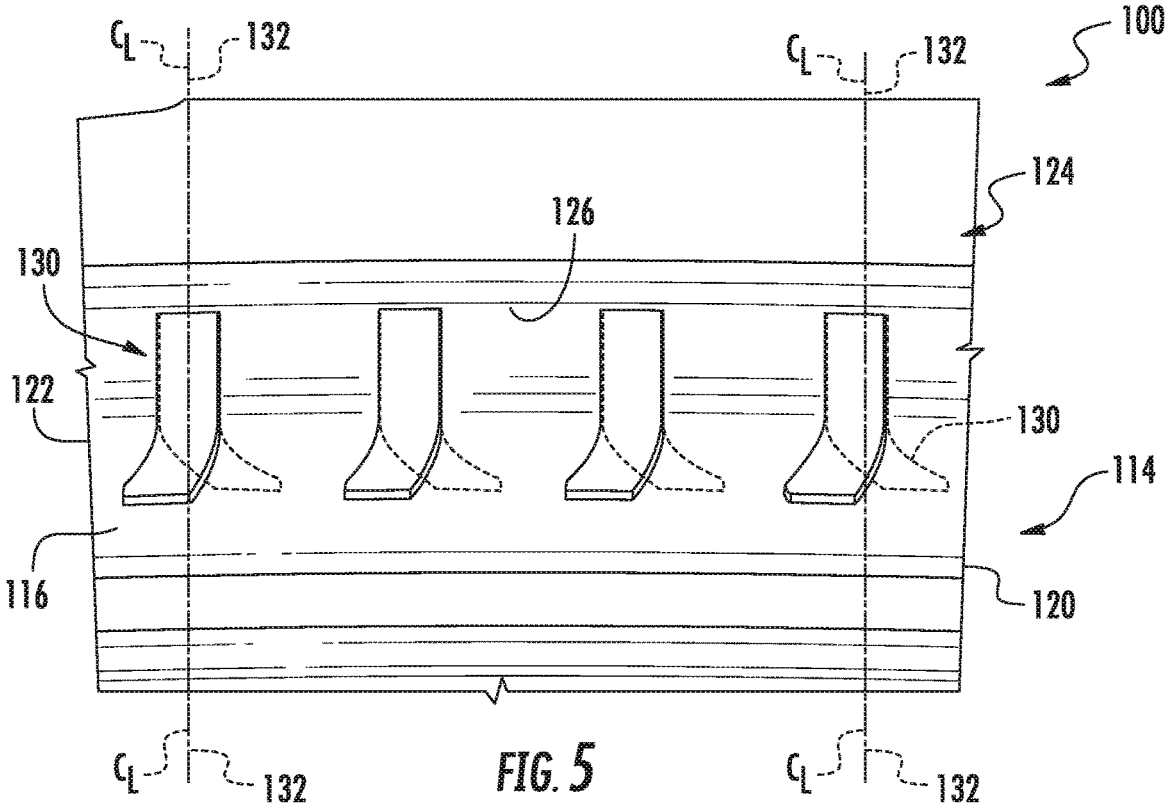
FIG. 5 provides an enlarged perspective view of a portion of the rotor blade as shown in FIG. 4, according to at least one embodiment of the present disclosure.

FIG. 4 provides an enlarged perspective view of a portion of the rotor blade 100 including the lip 124 according to at least one embodiment of the present disclosure. FIG. 5 provides an enlarged front view of the rotor blade 100 including the lip 124 according to at least one embodiment of the present disclosure. In various embodiments, the rotor blade 100 includes a plurality of swirler vanes 130 extending radially inwardly from the inward surface 126 of the lip 124 and axially outwardly from the forward wall 116 of the shank 114. The plurality of swirler vanes 130 extends radially inwardly from the inward surface 126 of the lip 124 and axially outwardly from the forward wall 116 of the shank 114 within the wheel space 44 (FIG. 2).

In particular embodiments, as shown in FIGS. 4 and 5 collectively, a respective portion of one or more of the swirler vanes 130, as shown in solid lines, is curved away from and/or forms an angle with respect to a radial centerline 132 of each respective swirler vane 130 towards the suction side wall 122. In particular embodiments, as shown in FIG. 5, a respective portion of each swirler vane 130, as shown in dashed lines, is curved away from and/or with respect to the radial centerline 132 of the respective swirler vane 130 towards the pressure side wall 120 of the shank 114.

In particular embodiments, as shown in FIG. 4, the rotor blade 100 includes a wing 134 that extends axially outwardly from the forward wall 116 of the shank 114. The wing 134 is positioned radially inwardly from the plurality of swirler vanes 130. In one embodiment, an end portion 136 of the wing 134 curves radially upwardly in the direction of and/or towards the swirler vanes 130.

In particular embodiments, as illustrated in FIGS. 4 and 5, one or more of the swirler vanes 130 is integrally formed with at least one of the lip 124, the platform 102 and the shank 114. For example, the platform 102, the airfoil, 112, the shank 114, the lip 124 and one or more of the swirler vanes 130 may be cast or additively manufactured as a singular body. In other embodiments, one or more of the swirler vanes 130 may be formed by a machining process such as electrical discharge machining or laser cutting.

Figure 6:
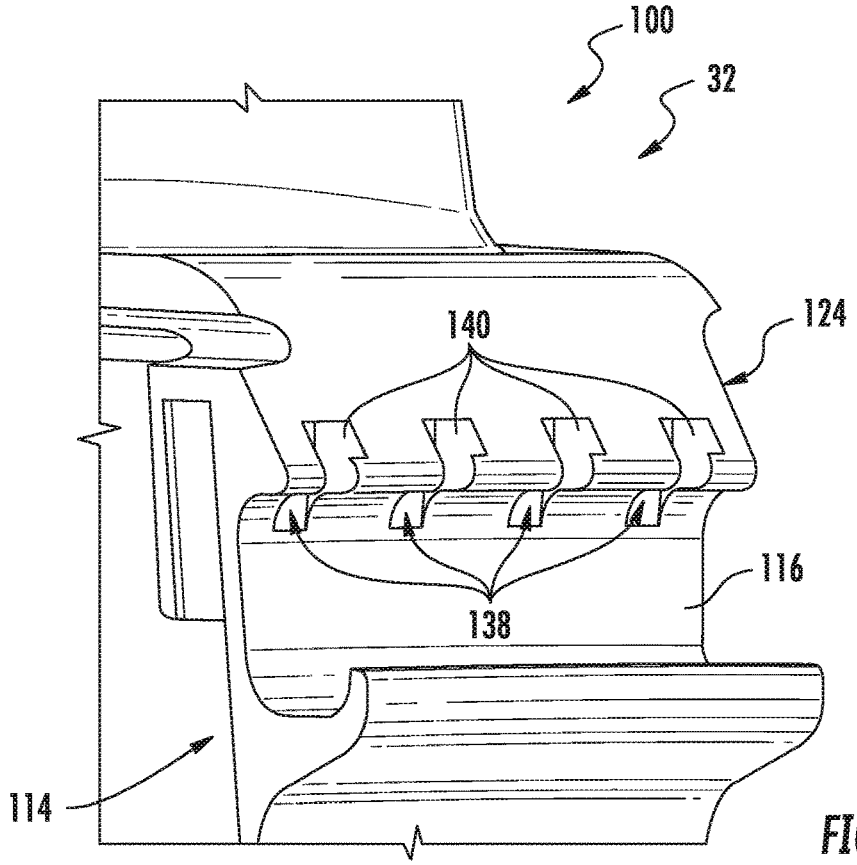
FIG. 6 provides an enlarged perspective view of a portion of an exemplary rotor blade according to at least one embodiment of the present disclosure.
Figure 7:
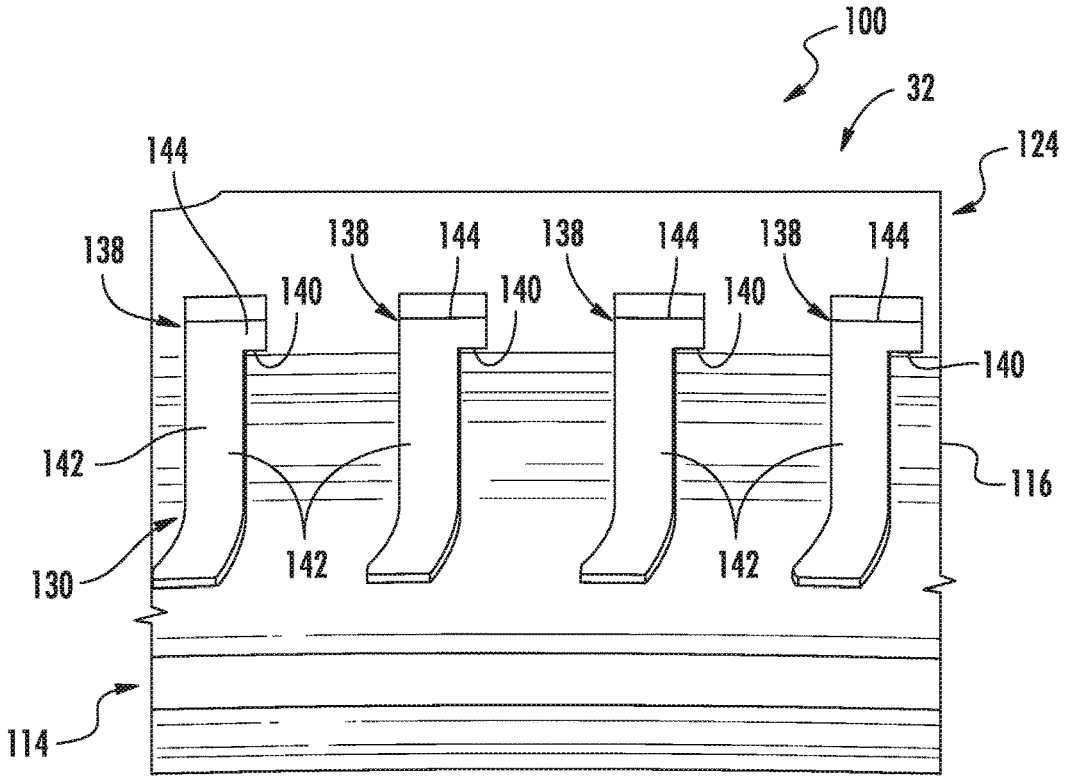
FIG. 7 provides an enlarged front view of the rotor blade as shown in FIG. 6, according to at least one embodiment of the present disclosure.

FIG. 6 provides an enlarged perspective view of a portion of the rotor blade 100 including the lip 124 according to at least one embodiment of the present disclosure. FIG. 7 provides an enlarged front view of the rotor blade 100 including the lip 124 according to at least one embodiment of the present disclosure. In particular embodiments as shown in FIG. 6, the lip 124 defines a plurality of slots 138. The slots 138 extend axially within the lip 124 away from the forward wall 116 of the shank 114. As shown in FIGS. 6 and 7 collectively, at least one slot 138 of the plurality of slots 138 includes a laterally or circumferentially extending step or notch 140.

Figure 8:
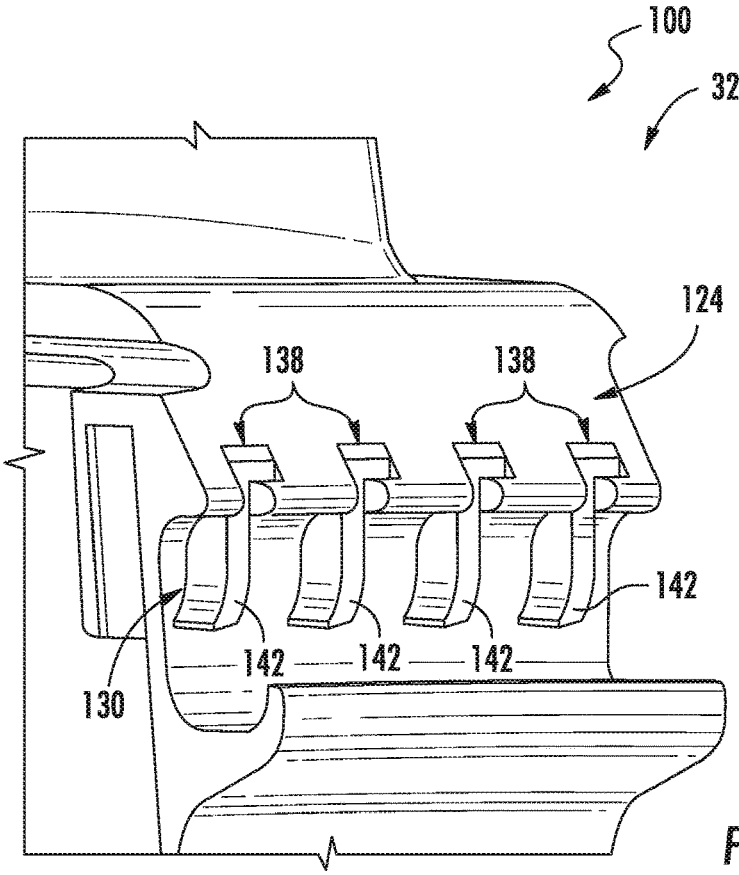
FIG. 8 provides an enlarged perspective view of a portion of the rotor blade as shown in FIG. 7, according to at least one embodiment of the present disclosure.

FIG. 8 provides an enlarged perspective view of a portion of the rotor blade 100 including the lip 124 according to at least one embodiment of the present disclosure. In particular embodiments, as shown in FIGS. 7 and 8, the plurality of swirler vanes 130 comprises a plurality of swirler vane inserts 142. Each swirler vane insert 142 is seated or inserted within a respective slot 138. In particular embodiments, as shown in FIG. 7, at least one of the swirler vane inserts 142 may include a protrusion 144 which extends into a respective step or notch 140 of the respective slot 138, thereby providing mechanical retention of the swirler vane insert 142.

Figure 9:
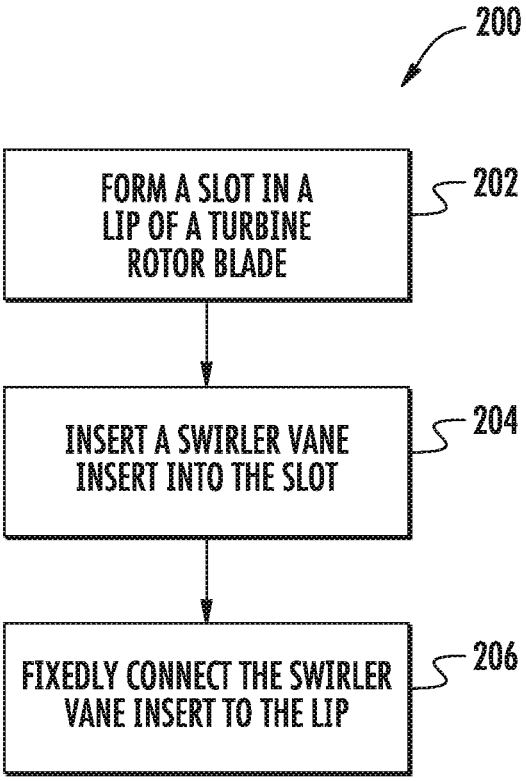
FIG. 9 provides a block diagram for a method for forming a rotor blade according to at least one embodiment of the present invention.

The various embodiments described and illustrated herein provide a first method 200 for manufacturing and/or modifying a rotor blade 100. FIG. 9 provides a block diagram for the method 200 for forming a rotor blade according to at least one embodiment of the present invention. At step 202, the method 200 includes forming the slot 138 in the lip 124 of the rotor blade 100 where the lip 124 extends axially outwardly from the forward wall 116 of the shank 114 of the rotor blade 100 and where the lip 124 defines a radially inward surface 126 and a radially outward surface 128. At step 204, method 200 includes inserting a swirler vane insert 142 into the axial slot 138 where the swirler vane insert 142 extends radially inwardly from the inward surface 126 of the lip 124 and axially outwardly from the forward wall 116 of the shank 114. At step 206, method 200 includes fixedly connecting the swirler vane insert 138 to the lip 124.

In one embodiment, forming the axial slot 138 in the lip 124 of the rotor blade 100 may include forming the laterally extending step or notch 140 in the slot 138. In one embodiment, fixedly connecting the swirler vane insert 142 to the lip 124 comprises at least one of staking and welding the swirler vane insert 142 to the lip 124.

The various embodiments described and illustrated herein provide a second method for manufacturing and/or modifying a rotor blade 100. The second method includes forming a plurality of swirler vanes across a lip of the rotor blade where the lip extends axially outwardly from a forward wall of a shank of the rotor blade and where each swirler vane extends radially inwardly from a radially inward surface of the lip and extends axially outwardly from a forward wall of the shank of the rotor blade.

In one embodiment, forming the plurality of swirler vanes in the lip of the rotor blade comprises casting. In one embodiment, forming the plurality swirler vanes in the lip of the rotor blade comprises machining and/or laser cutting. In one embodiment, a portion of each swirler vane of the plurality of swirler vanes may be formed so as to curve towards a suction side wall of the shank. In one embodiment, a portion of each swirler vane of the plurality of swirler vanes may be formed so as to curve towards a pressure side wall of the shank.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rotor blade, comprising:

a platform having a bottom side radially spaced from a top side and a leading edge portion axially spaced from a trailing edge portion;

an airfoil that extends radially outwardly from the top side of the platform;

a shank extending radially inwardly from the bottom side of the platform, the shank having a forward wall, an aft wall, a pressure side wall and a suction side wall and a lip that extends axially outwardly from the forward wall, the lip defining a radially inward surface and a radially outward surface, wherein the lip defines a plurality of slots; and a plurality of swirler vane inserts, each swirler vane insert disposed within a respective slot of the plurality of slots, wherein each swirler vane insert extends radially inwardly from the inward surface of the lip and axially outwardly from the forward wall of the shank.

2. The rotor blade as in claim 1, wherein at least one slot of the plurality of slots includes a laterally extending step.

3. The rotor blade as in claim 1, wherein a portion of each swirler vane insert of the plurality of swirler vane inserts is curved towards the suction side wall of the shank.

4. The rotor blade as in claim 1, wherein a portion of each swirler vane insert of the plurality of swirler vane inserts is curved towards the pressure side wall of the shank.

5. The rotor blade as in claim 1, wherein the radially outward surface of the lip is blended with the leading edge portion of the platform.

6. The rotor blade as in claim 1, further comprising a wing that extends axially outwardly from the forward wall of the shank, wherein the wing is positioned radially inwardly from the plurality of swirler vane inserts.

7. The rotor blade as in claim 6, wherein an end portion of the wing curves radially upwardly.

8. A method for forming a rotor blade, comprising:

forming a slot in a lip of the rotor blade, wherein the lip extends axially outwardly from a forward wall of a shank of the rotor blade, wherein the lip defines a radially inward surface and a radially outward surface;

inserting a swirler vane insert into the slot, wherein the swirler vane insert extends radially inwardly from the inward surface of the lip and axially outwardly from the forward wall of the shank; and fixedly connecting the swirler vane insert to the lip.

9. The method as in claim 8, wherein forming an axial slot in a lip of the rotor blade further comprises forming a laterally extending step in the slot.

10. The method as in claim 9, wherein the step is formed complementary to a protrusion formed on the swirler vane insert.

11. The method as in claim 8, wherein fixedly connecting the swirler vane insert to the lip comprises at least one of staking and welding the swirler vane insert to the lip.

12. The method as in claim 8, wherein a portion of the swirler vane insert is formed so as to curve towards a pressure side wall of the shank.

13. The method as in claim 8, wherein a portion of the swirler vane insert is formed so as to curve towards a pressure side wall of the shank.

14. The method as in claim 8, further comprising forming a plurality of slots in the lip of the rotor blade and inserting a respective swirler vane insert into each slot of the plurality of slots.

15. A method for forming a rotor blade, comprising:

forming a plurality of slots across a lip of the rotor blade, wherein the lip extends axially outwardly from a forward wall of a shank of the rotor blade and is positioned radially outwardly from a wing of the rotor blade; and inserting a plurality of swirler vanes into the plurality of slots across the lip, whereby each swirler vane is disposed within a respective slot of the plurality of slots, and each swirler vane extends radially inwardly from a radially inward surface of the lip towards the wing of the rotor blade and extends axially outwardly from a forward wall of the shank of the rotor blade.

16. The method as in claim 15, wherein forming the plurality of slots in the lip of the rotor blade comprises casting.

17. The method as in claim 15, wherein forming the plurality of slots in the lip of the rotor blade comprises machining.

18. The method as in claim 15, wherein a portion of each swirler vane of the plurality of swirler vanes is formed so as to curve towards a suction side wall of the shank.

19. The method as in claim 15, wherein a portion of each swirler vane of the plurality of swirler vanes is formed so as to curve towards a pressure side wall of the shank.

* * * * *